United States Patent [19]

Gooding

[11] Patent Number: 4,538,443

[45] Date of Patent: Sep. 3, 1985

[54] PORTABLE TOOL FOR AFFIXING TERMINALS ONTO BATTERY CABLES

[75] Inventor: Robert J. Gooding, Chester Springs, Pa.

[73] Assignee: Action Concepts, Inc., Chester Springs, Pa.

[21] Appl. No.: 568,134

[22] Filed: Jan. 4, 1984

Related U.S. Application Data

[63] Continuation-in-part of Ser. No. 402,099, Jul. 26, 1982, Pat. No. 4,445,358.

[51] Int. Cl.[3] ..... B21D 37/10

[52] U.S. Cl. ..... 72/416; 72/454

[58] Field of Search ..... 72/416, 414, 410, 479, 72/472, 470, 454, 116, 317

[56] References Cited

U.S. PATENT DOCUMENTS

| | | | |
|---|---|---|---|
| 1,724,697 | 8/1929 | Dobrick | 72/116 |
| 2,763,171 | 9/1956 | Modrey et al. | 72/410 |
| 4,445,358 | 5/1984 | Gooding | 72/416 |

*Primary Examiner*—Lowell A. Larson
*Assistant Examiner*—Linda McLaughlin
*Attorney, Agent, or Firm*—Charles A. McClure

[57] ABSTRACT

Portable swaging tool for affixing a battery terminal onto an electrically conducting cable, such as for the starting motor of an internal combustion engine, especially with the cable already installed in the confined space of a vehicle engine compartment. Portions of a short handle member and a pivoted clamping member have cooperating jaws to receive a battery terminal between them. The handle member carries clamping means adapted to engage the clamping member to force the jaws together sufficiently to swage a terminal onto a cable end inserted into a bore in the terminal.

10 Claims, 11 Drawing Figures

Fig. 8
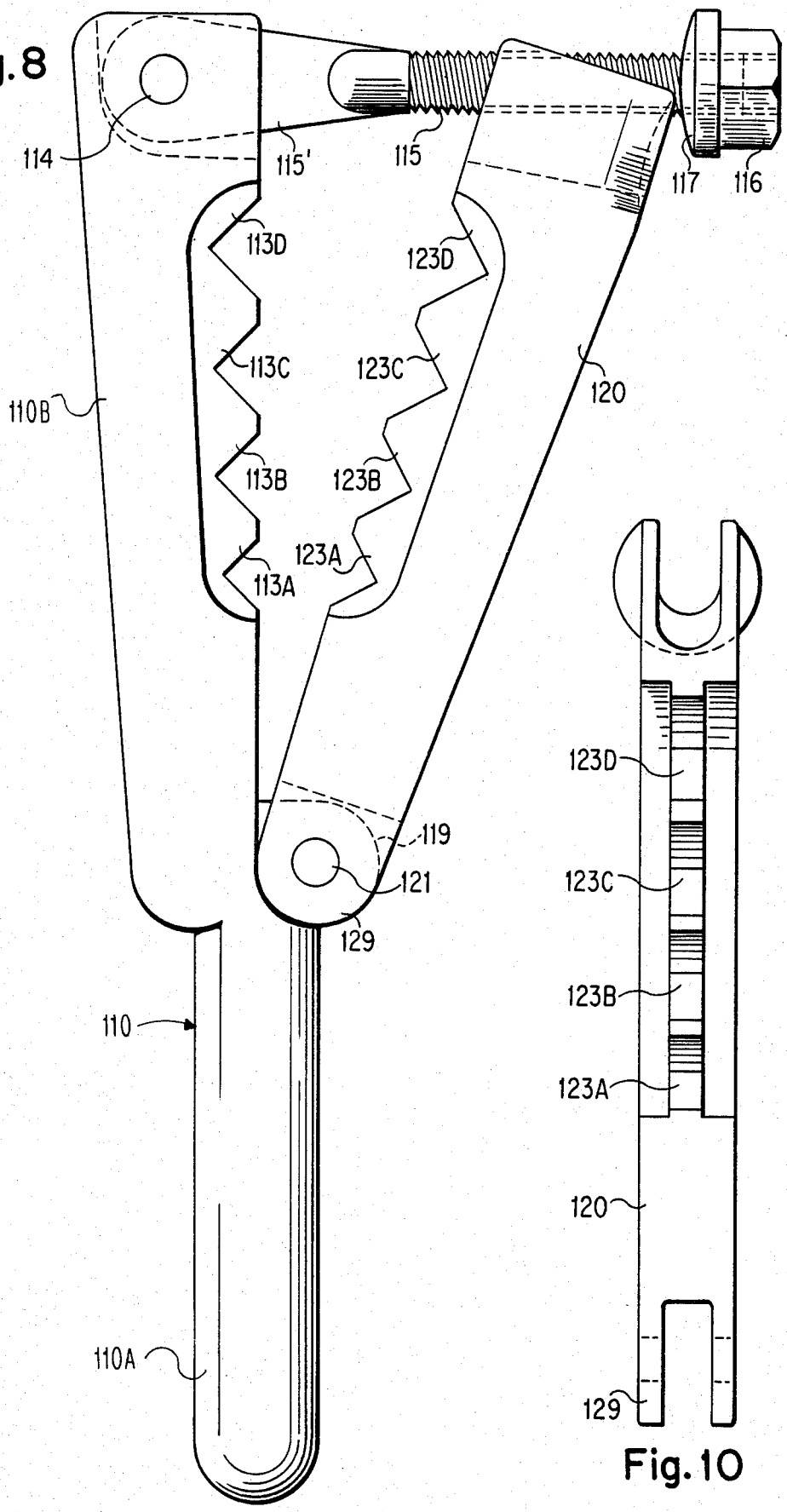
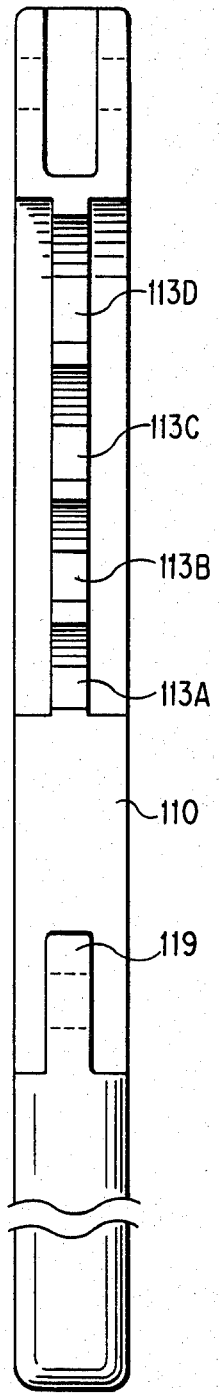
Fig. 9
Fig. 10

PORTABLE TOOL FOR AFFIXING TERMINALS ONTO BATTERY CABLES

This application is a continuation-in-part of my similarly entitled prior copending application, Ser. No. 402,099 filed on July, 26, 1982, now U.S. Pat. No. 4,445,358.

This invention relates to a portable swaging tool for affixing terminals onto battery cables suitable for conducting substantial currents, as from an electrical storage battery for operating a starter motor for an internal combustion engine.

When a battery cable and terminal become separated from one another—whether by reason of corrosion or otherwise—the free end of the cable may be inserted into a shank portion of the terminal pre-bored to receive it, and the terminal shank be swaged tightly onto the cable end to retain it. This usually is accomplished, or at least attempted, by means of a long-handled tool similar to the familiar bolt-cutter but having its jaws suited to deforming the terminal rather than cutting or shearing it. However, access to the end of cable to sufficient extent to position such a tool properly, especially in the open position, often is impossible without detaching a substantial length of the cable—sometimes at nearly inaccessible bracket or clamp locations.

Attempts to meet the need for a smaller device to accomplish this important purpose have proved unsatisfactory, as by requiring excessive assembly or manipulation, such as in Shaffer U.S. Pat. No. 3,577,622. Tools for crimping terminals onto wires for carrying fractional ampere currents, as in Paolino U.S. Pat. No. 4,043,174, are incapable of coping with the demands imposed by the need for a cable-terminal combination capable of conducting current of dozens or hundreds of amperes. Nor do tools for distorting tubing, as by pinching it, as in Wilson U.S. Pat. No. 3,172,454, or by flaring it, as in Dobrich U.S. Pat. No. 1,724,697, contribute appreciably toward meeting this need.

A primary object of the present invention is provision of a portable tool for swaging terminals onto electrical cables for use with electrical storage batteries of high current capacity.

Another object of this invention is such a tool to which enough clamping force to swage a terminal onto the cable can be applied either manually with a wrench or by rotary drive means.

A further object is provision of such a tool adapted for use on terminals and cables of different sizes and current ratings.

Other objects of the invention, together with means and methods for attaining the various objects, will be apparent from the following description and accompanying diagrams of preferred embodiments, which are presented by way of example rather than limitation.

FIG. 8 shows, in side elevation, a second embodiment of tool according to this invention, in open or unclamped position;

FIG. 9 shows, in front elevation or edge-on toward its jaw, the handle member of the tool of FIG. 8;

FIG. 10 shows, in rear elevation or edge-on toward its jaw, the clamping member of the tool of FIG. 8.

In general, the objects of the present invention are accomplished, in a portable tool for swaging a battery cable terminal onto a battery cable, by means of a handle member and a clamping member pivoted together and carrying a pair of cooperating jaws, adapted to swing open to receive a cable terminal therebetween and to swing closed thereonto. The handle member carries clamping screw means adapted to engage an end of the clamping member and to force it against the handle sufficiently forcibly to swage the battery cable terminal pre-inserted between the jaws and thereby to affix it onto a battery cable pre-inserted into a bore therein.

Figure 1:
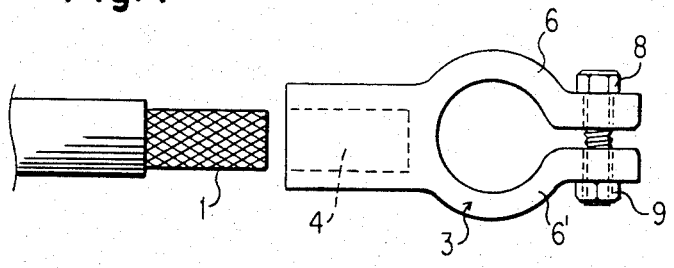
FIG. 1 shows, in side elevation, an electrical cable and a terminal suitable for attachment together according to the present invention.

FIG. 1 shows from the side an end portion of electrical cable 1 and unattached terminal 3 adapted to be fixed onto the cable. The terminal has blind bore 4 in its cylindrical shank portion and has pair of arcuately curved arms 6,6' bored through their free ends. Bolt 8 with nut 9 thereon ties the ends together. A simpler form of terminal, with a circular opening in a flat end, instead of the split arms and the bolt and nut combination, would be similarly useful, of course, if bored likewise or if otherwise similarly open and thereby adapted to receive the cable end.

Figure 2:
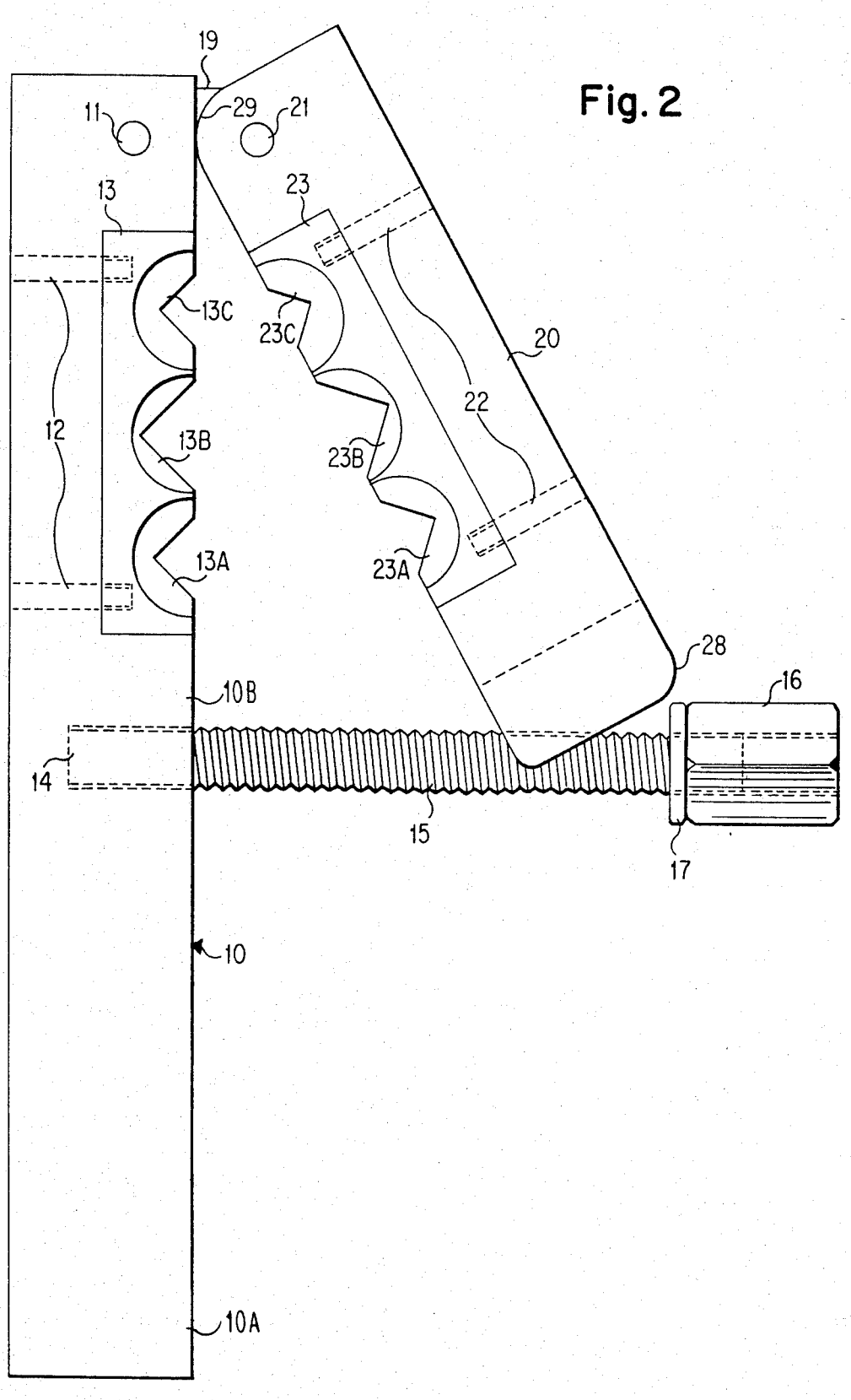
FIG. 2 shows, also in side elevation, a first embodiment of tool according to this invention, in open or unclamped position.

FIG. 2 shows, from the side, handle member 10 and clamping member 20 in their open or unclamped position. They are secured together by tiepiece 19 (barely visible in this view), on the end of the clamping portion—as distinct from the holding portion—of the handle member, and pin 11 through it and the adjacent end of the clamping member. Corner 29 of this adjacent end is rounded to enable the clamping member to swing on the pivot without binding. Free end 24 of the clamping member has slot 25 to enable that end to straddle stud 15 of distinct clamping means as the clamping member swings toward the closed position. The stud is secured to the handle member in bore 14, between the holding (10A) and the clamping (10B) portions thereof, and it carries nut 16 and washer 17 adapted to bear against the bifurcated slot-defining portion of end 24 of the clamping member. Rotation of the nut further onto the stud when so engaged forces the clamping member toward the handle member and to the clamped or closed position, whereas opposite rotation will enable the clamping member to swing away therefrom and disengage. As shown, the stud is long enough so that rounded corner 28 of the clamping member swings clear of the nut and washer when they are backed off to a position near the free end of the stud.

Figure 3:
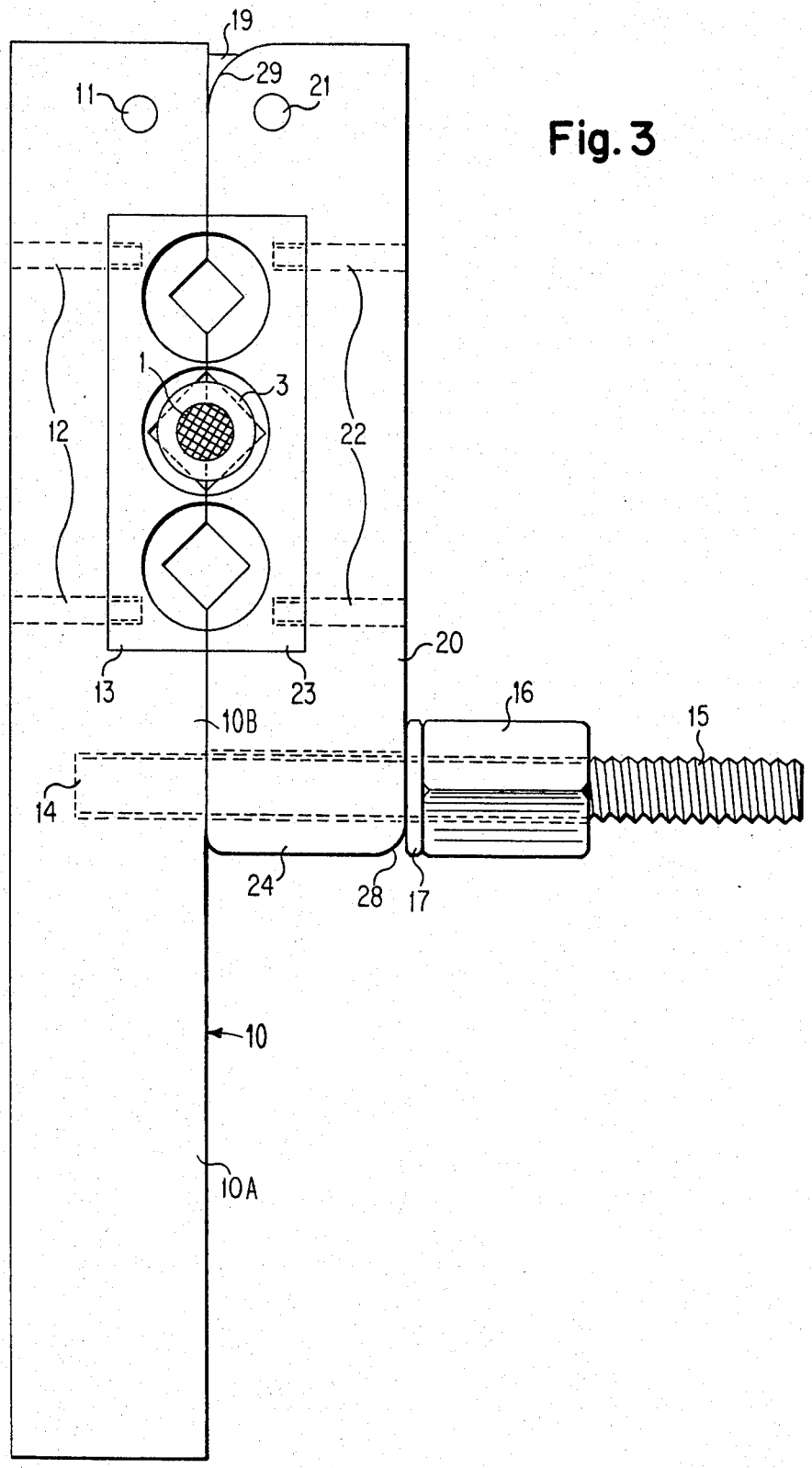
FIG. 3 shows, in like elevation, the tool of FIG. 2 in closed or clamped position, and with a terminal and cable (sectioned) in place therein.
Figure 4:
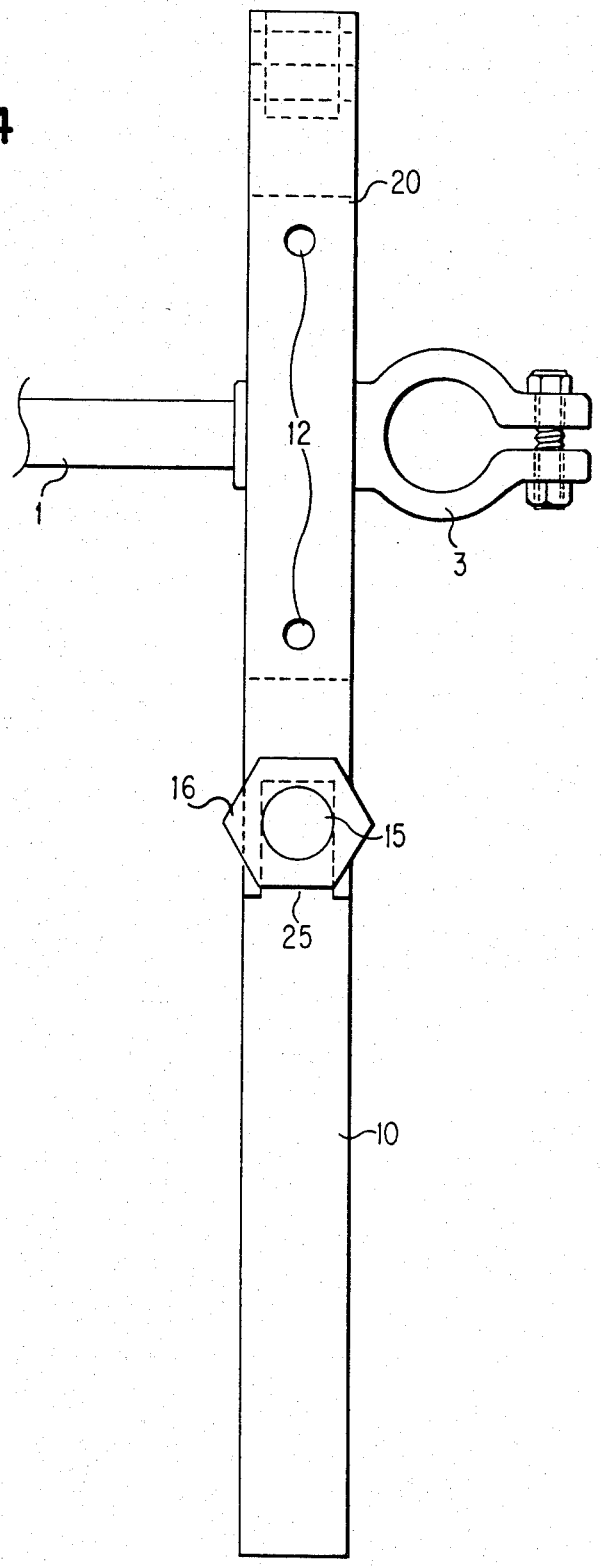
FIG. 4 shows the tool of preceding views, in front elevation or edge-on from the direction to which the clamping member opens.

FIGS. 3 and 4 show, from the side and front, respectively, the tool of FIG. 2 clamped onto the shank portion of terminal 3 of FIG. 1, with the end of cable 1 inserted into the terminal bore and shown sectioned in FIG. 3 and broken away in FIG. 4. Nut 16 of the clamping means 16 is shown screwed down sufficiently onto stud 15 thereof to force clamping member 20 against the clamping portion of handle member 10 and thereby swage the terminal between the juxtaposed pair of jaws on the respective members tightly onto the cable end. As noted, this may be accomplished manually by means of a wrench or by a hand-held rotary drive tool.

Figure 5:
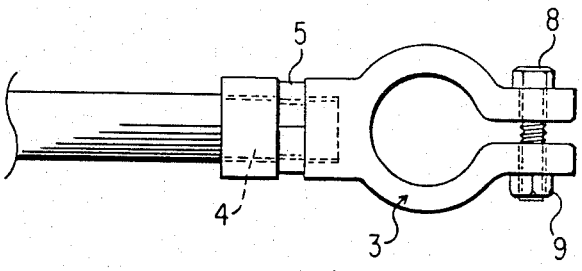
FIG. 5 shows, in side elevation, the resulting assembled cable and terminal combination, without the tool present.

FIG. 5 shows the resulting assembly of terminal 3 and cable 1 affixed together by the portable swaging tool of this invention, as just described. The formerly smooth shank of terminal 3 now has indentation 5 (with square transverse cross-section), where cooperating jaws 13 and 23 have swaged the constituent lead, etc.

Figure 6:
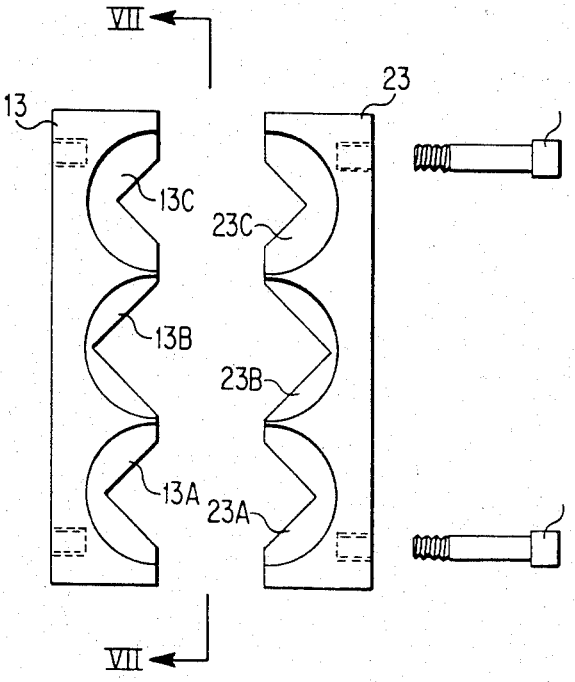
FIG. 6 shows, in side elevation, a pair of jaws insertable into and removable from the handle and clamping members of the previously depicted tool.

FIG. 6 shows, from the side, matched pair of jaws 13, 23 apart from the rest of the first embodiment of this invention, either previous to insertion into, or after having been removed from, the handle and clamping members. For versatility, the jaws of this tool include several sizes of matched pairs of toothed swaging surfaces: 13A, 23A; 13B, 23B; and 13C, 23C. The two jaws are retained in their respective members by pairs of retaining screws in pairs of bores 12 and 22, shown in preceding views. The jaws are readily removed for maintenance or replacement by loosening the retaining screws.

Figure 7:
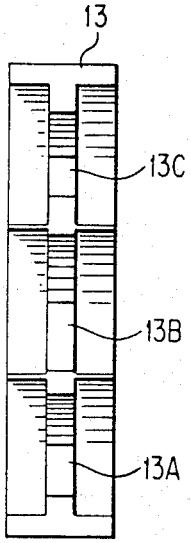
FIG. 7 shows one such jaw, in front elevation or edge-on toward the serrated edge thereof.

FIG. 7 shows edge-on the swaging surfaces of jaw 13, being (as in jaw 23) relieved on each side to be narrower than the full jaw width, which fits flush with the supporting member side edges.

The last mentioned diagram concludes the showing of the first embodiment of this invention. The succeeding diagrams illustrate another or second embodiment, and reference numerals therein are larger by 100 when designating parts corresponding or analogous to (lower numbered) parts referenced in the first embodiment.

FIG. 8 shows, from the side, the second tool embodiment, with handle member 110 and clamping member 120 pivotally connected by pin 121 through boss 119, located on the front edge of the handle member between the holding (110A) and clamping (110B) portions thereof, about which rounded bifurcated end 129 of the clamping member fits. Distinct clamping means or swing bolt comprising pivoted end 115' and threaded stud member 115 with nut 116 and integral washer 117 thereon is swung away from engagement with bifurcated opposite end of the clamping member, on pivot pin 114 through the end of the handle member nearer the clamping portion.

FIGS. 9 and 10 show the respective members edge-on, toward the jaws. Thus FIG. 10 best shows the bifurcation of both ends of the clamping member, whereas FIG. 9 best shows the boss on the handle member and the bifurcated recessing of the clamping end portion thereof within which the stud supporting end of the clamping means pivots. Four matched pairs of swaging surfaces appear on the respective jaw portions: 113A, 123A; 113B, 123B; 113C, 123C; and 113D, 123D.

Figure 11:
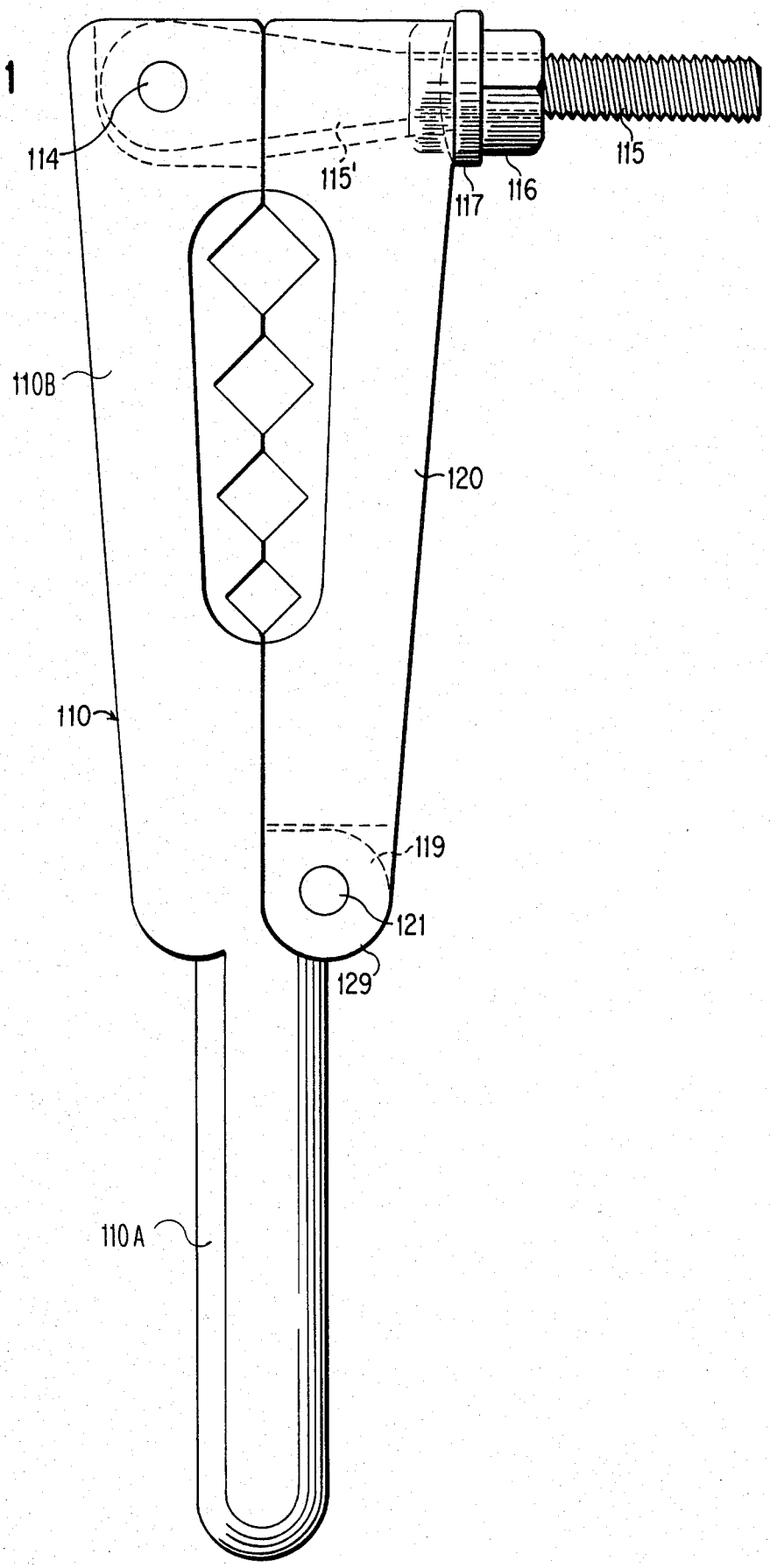
FIG. 11 shows, in side elevation, the same tool, in closed or clamped position.

FIG. 11 shows this tool embodiment closed in clamped position. Because of their previous showing in views of the first embodiment the cable and terminal (which would look the same here) are not shown again. Notable are interchange of the interconnecting pivot for the handle and clamping members and the basing of the stud (also pivoted in the second case), also alignment of the holding portion of the handle member with the center line of the jaws when juxtaposed. Both tools are similarly useful in affixing battery—or other—terminals onto electrical cables. Either embodiment may have either integral or removable jaws. The handle member with the center-line holding portion is more convenient to use, though, than the straight-through handle member. Either way, the portable swaging tool of this invention provides operational efficiency not attinable with prior tools for affixing terminals onto battery cables, especially where the cables are already installed in the confined space of a vehicle engine compartment, for example.

Other modifications may be made in the tool or its use, as by adding, combining, deleting, subdividing, or substituting parts or steps, while retaining some of the benefits of this invention, which itself is defined in the following claims.

I claim:

1. Portable tool for affixing a terminal onto an end of an electrical cable by swaging, comprising a handle member having a holding portion and a clamping portion, a clamping member pinned pivotally to the handle member, the respective members having jaws adapted to swage a terminal therebetween upon pivoting closed, and clamping means carried by the handle member and adapted to engage the clamping member and to close the jaws forcibly enough to swage the terminal onto a cable inserted into a bore in the terminal.

2. Tool according to claim 1, wherein the clamping means is attached at one of its ends to the handle member intermediate the holding and clamping portions thereof, and the clamping member is attached at one of its ends to the free end of the handle member.

3. Tool according to claim 1, wherein the clamping means is attached at one of its ends to the free end of the handle member, and the clamping member is attached at one of its ends to the handle member intermediate the holding and clamping portions thereof.

4. Tool according to claim 3, wherein the holding portion of the handle member is aligned with the center line of the jaws when juxtaposed, and the clamping portion thereof is accordingly offset from the holding portion.

5. Portable tool for swaging a replacement terminal onto a battery cable already installed in the confined space of a vehicle engine compartment, comprising a handle member of given length having both a holding portion and a clamping portion, a shorter clamping member pivotally attached at one of its ends to the handle member at one end of the clamping portion, and clamping means attached to the handle member at the other end of the clamping portion and thereby being adapted to engage the free end of the clamping member and to force the clamping member against the clamping portion of the handle member sufficiently to swage a terminal placed therebetween tightly onto a battery cable inserted into a bore in the terminal.

6. Tool according to claim 5, wherein the clamping means comprises a threaded member and a nut threaded thereon, and the free end portion of the clamping member is slotted and is thereby adapted to straddle the threaded member with the nut thereon in engagement with the free end portion of the clamping member so as to enable the clamping member to be forced by the nut toward the handle member and to the closed or clamping position of the tool.

7. Tool according to claim 6, wherein the holding portion of the handle member is aligned with the center line of the jaws when juxtaposed in the closed position.

8. Tool according to claim 6, wherein the clamping member is pivotally attached to the handle member intermediate the holding and clamping portions, and the threaded member of the clamping means is pivotally attached to the handle member at the free end thereof.

9. Method of affixing a replacement terminal by swaging onto an end of a battery cable installed in such a confined space as the engine compartment of a motor vehicle, comprising gripping the terminal between a pair of jaws adapted to be juxtaposed to one another in swaging configuration, inserting the cable end into the terminal, pivoting the jaws together sufficiently forcibly to swage the terminal tightly onto the cable end, and thereafter opening the jaws to release the terminal therefrom.

10. Method of terminal replacement according to claim 9, wherein the jaws are on clamping portions of respective first and second members pivoted together, the first such member comprising also a holding portion extending from its clamping portion, and including juxtaposing the jaws by applying force to a free end of the second member to pivot it and its clamping portion toward the clamping portion of the first member.

* * * * *